US007040618B2

(12) United States Patent
Mönch

(10) Patent No.: US 7,040,618 B2
(45) Date of Patent: May 9, 2006

(54) STACKING UNIT FOR ARTICLES SHEET FORM

(75) Inventor: Mario Mönch, Unterhaching (DE)

(73) Assignee: Giesecke & Devrient GmbH, Munich (DE)

( * ) Notice: Subject to any disclaimer, the term of this patent is extended or adjusted under 35 U.S.C. 154(b) by 28 days.

(21) Appl. No.: 10/203,631

(22) PCT Filed: Feb. 19, 2001

(86) PCT No.: PCT/EP01/01842

§ 371 (c)(1),
(2), (4) Date: Dec. 10, 2002

(87) PCT Pub. No.: WO01/62642

PCT Pub. Date: Aug. 30, 2001

(65) Prior Publication Data

US 2003/0146569 A1 Aug. 7, 2003

(30) Foreign Application Priority Data

Feb. 22, 2000 (DE) ..... 100 08 136

(51) Int. Cl.
*B65H 29/20* (2006.01)

(52) U.S. Cl. ..... 271/315

(58) Field of Classification Search ..... 271/315
See application file for complete search history.

(56) References Cited

U.S. PATENT DOCUMENTS 3,162,438 A 12/1964 Perry, Jr.
3,912,255 A * 10/1975 McInerny ..... 271/315
4,052,053 A * 10/1977 Hasegawa et al. ..... 271/187
4,088,314 A * 5/1978 Phillips ..... 271/176
4,150,757 A * 4/1979 Laybourn et al. ..... 271/187

(Continued)

FOREIGN PATENT DOCUMENTS

CH 403 364 11/1965

(Continued)

OTHER PUBLICATIONS http://www.trimarkcorp.com/goweb/corporate/glossary.jsp (website last visited Aug. 1, 2005).*

(Continued)

*Primary Examiner*—Kathy Matecki
*Assistant Examiner*—M Kohner
(74) *Attorney, Agent, or Firm*—Bacon & Thomas, PLLC

(57) ABSTRACT

Stacker 1 for sheet-shaped objects is described having feeding device 3 for depositing sheet-shaped objects 2 in storage pocket 4 with variable capacity. Storage pocket 4 has contact surface 5 against which sheet-shaped objects 2 deposited in storage pocket 4 lie with one edge 6, and storage tray 7 on which sheet-shaped objects 2 are stacked in storage pocket 4 flat and parallel to storage tray 7. Storage tray 7 is mounted movably for changing the capacity of storage pocket 4. Storage pocket 4 is disposed with contact surface 5 at an angle to the horizontal so that sheet-shaped objects 2 stacked in storage pocket 4 rest with their edges 6 on contact surface 5 and the resulting frictional force between edges 6 of sheet-shaped objects 2 and contact surface 5 substantially compensates the slope descending force acting on stack 10 formed of sheet-shaped objects 2 in the direction of storage tray 7. Feeding device 3 exerts a force on stack 10 when depositing sheet-shaped object 2 at least as of certain stack thickness c, thereby moving storage tray 7 so as to enlarge the capacity of storage pocket 4.

6 Claims, 1 Drawing Sheet

U.S. PATENT DOCUMENTS

| | | | | | |
|---|---|---|---|---|---|
| 4,275,874 | A | * | 6/1981 | DiBlasio | 271/4.1 |
| 4,342,325 | A | * | 8/1982 | Lundblad | 221/7 |
| 4,474,365 | A | * | 10/1984 | DiBlasio | 271/3.2 |
| 4,506,882 | A | | 3/1985 | Ito et al. | |
| 4,556,212 | A | * | 12/1985 | Nogi et al. | 271/315 |
| 4,570,801 | A | | 2/1986 | Brannen | |
| 4,629,174 | A | * | 12/1986 | Wakisaka et al. | 271/186 |
| 4,968,015 | A | * | 11/1990 | Calverley et al. | 271/4.1 |
| 5,163,672 | A | * | 11/1992 | Mennie | 271/187 |
| 6,185,905 | B1 | | 2/2001 | Neri | |
| 6,216,591 | B1 | * | 4/2001 | Nanba | 101/232 |
| 6,276,678 | B1 | * | 8/2001 | Nottelmann et al. | 271/3.01 |
| 6,581,927 | B1 | * | 6/2003 | Claudio | 271/187 |
| 2002/0113366 | A1 | * | 8/2002 | Watanabe et al. | 271/315 |

FOREIGN PATENT DOCUMENTS

| | | | | |
|---|---|---|---|---|
| DE | 32 47 293 | A1 | | 7/1983 |
| DE | 197 36 453 | A1 | | 2/1999 |
| DE | 199 24 576 | A1 | | 12/1999 |
| EP | 0 166 253 | | | 1/1986 |
| EP | 339936 | A1 | * | 11/1989 |
| FR | 2 561 632 | | | 9/1985 |
| JP | 61221036 | A | * | 10/1986 |
| JP | 63037039 | A | * | 2/1988 |
| JP | 01053957 | A | * | 3/1989 |
| JP | 01187167 | A | * | 7/1989 |
| JP | 02100963 | A | * | 4/1990 |
| JP | 02188371 | A | * | 7/1990 |
| WO | WO 99/10846 | | | 3/1999 |

OTHER PUBLICATIONS http://www.efunda.com/DesignStandards/springs/spring_extension.cfm (website last visited Aug. 1, 2005).*

E.L. Fitch: "Increased Capacity Stacker," IBM Technical Disclosure Bulletin, vol. 15, No. 12, May 1973, p. 3592.

T.J. Johnson: "Ramp Counterbalance for Document Stacker," IBM Technical Disclosure Bulletin, vol. 17, No. 8, Jan. 1975, pp. 2398-2399.

* cited by examiner

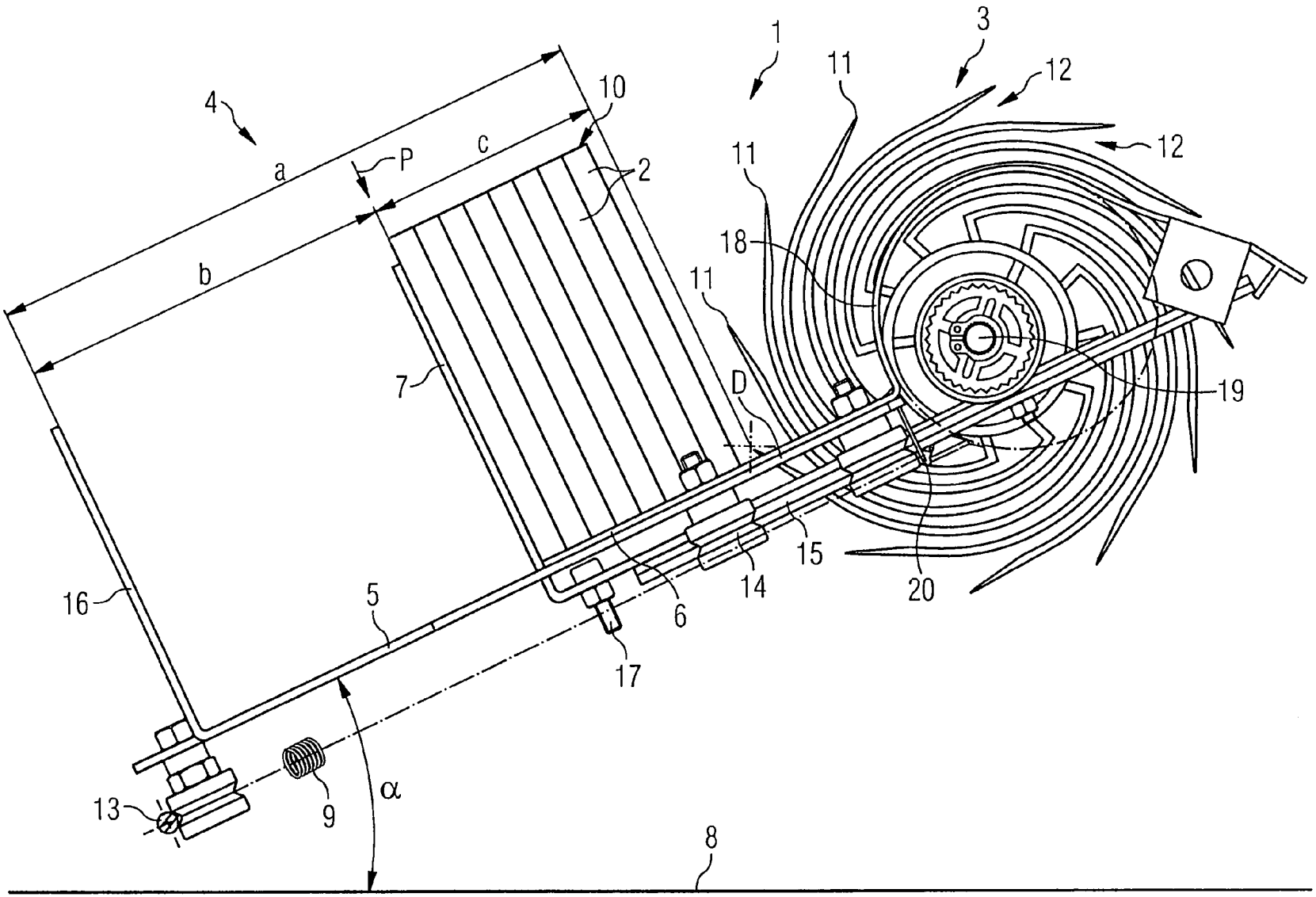
1
2
3
4
5
6
7
8
9
10
11
12
13
14
15
16
17
18
19
20
a
b
c
D
P
α

STACKING UNIT FOR ARTICLES SHEET FORM

BACKGROUND

The present invention relates to a stacker for sheet-shaped objects, in particular bank notes, having a feeding device for depositing the sheet-shaped objects in a storage pocket with variable capacity.

Stackers for flat sheet-shaped objects are used in particular in automatic sorters, testers and counters, for example for bank notes, for receiving or temporarily storing the objects after testing, sorting and counting. Simple stackers normally have a storage pocket of fixed size that is intended for example for precisely 100 bank notes of a certain thickness. In addition, DE 27 29 830 C2 discloses a bank note sorting device wherein sorted bank notes are stacked in storage containers, the size of the storage containers being variable in accordance with the stack height of the notes. For this purpose a baseplate on which the notes are deposited is lowered by means of a threaded spindle for receiving the growing bank note stack in the storage container. Such stackers are thus not limited to a fixed number of notes. However, elaborate control is required for the threaded spindle for changing the size of the storage container.

SUMMARY

In addition, FR 2 561 632 A1 discloses a sorting apparatus for letters wherein letters are received in a storage container having a contact surface inclined 10° to the horizontal, on which the edges of the letters rest.

It is the problem of the present invention to develop the known prior art for bank notes.

As in known stackers, the inventive stacker has feeding device for depositing the sheet-shaped objects in a storage pocket. The storage pocket likewise has a storage tray on which the sheet-shaped objects are stacked flat and parallel to the storage tray, and a contact surface against which the sheet-shaped objects lie with one edge. It is expressly pointed out that the term "storage tray" refers here not only to a continuous tray but also to a tray in the form of a grid, a single bar or a plurality of side-by-side bars grasping under the stack like a fork for example. Also, the contact surface need not necessarily be a continuous surface but can likewise be formed of bars or the like.

In contrast to known stackers, the contact surface of the storage pocket is disposed at an angle to the horizontal in the inventive stacker so that the sheet-shaped objects stacked in the storage pocket rest with their edges on the contact surface and the resulting frictional force between the edges of the sheet-shaped objects and the contact surface substantially compensates the slope descending force acting on the stack of sheets in the direction of the storage tray. That is, the stack is located roughly in equilibrium independently of the mass of the stack. The precise angle of inclination at which slope descending force and frictional force are compensated depends on the coefficient of friction of the paper edges on the contact surface and can vary depending on the type of sheet material. It has turned out that, for paper notes and a metal contact surface, the ideal angle of inclination of the contact surface is normally between 20° and 30° to the horizontal, preferably about 20.

The feeding device is designed or disposed so as to exert a force on the stack when depositing a sheet-shaped object at least as of a certain stack thickness, thereby moving the storage tray so as to enlarge the capacity of the storage pocket. Thus, a passive guidance is involved here that does without any control. The size of the storage pocket adapts automatically to the stack thickness. Since the system is independent of the mass of the stack, functioning is guaranteed for all bank note formats. It is to be heeded that the total weight of a bank note stack can fluctuate considerably depending on the type of note and is therefore normally very relevant. For 500 notes for example, the total weight is between 250 and 750 grams depending on the type of note.

In an especially preferred embodiment, the storage tray is urged into a starting position by means of a spring element and displaced against this spring force by the feeding device. The spring element ensures firstly that the storage tray is returned automatically to the starting position upon removal of the stack and does not have to be moved back to the starting position by hand. Secondly, the spring element slightly counteracts the shearing force produced by the feeding device during stacking. Due to this bias, the storage tray is displaced by the feeding device during stacking of a sheet-shaped object only by the required path, i.e. by the thickness of the stacked object. The stack of sheets is thus quasi clamped between the element of the feeding device exerting the force on the stack from above and the storage tray.

The spring element can be for example an extension spring, a compression spring or a pneumatic or hydraulic element. The spring constant should be dimensioned so as to guarantee a minimum biasing force so that the storage tray is reliably guided back upon removal of the stack even if the device is relatively old, partly worn out or soiled. On the other hand, the spring constant should be as low as possible so that the change of spring tension is minimal upon displacement of the storage tray, i.e. when the stack becomes larger. Thus, the force to be applied to the stack of sheets by the feeding device is negligibly low even at maximum stack height, on the one hand, and the change of force over the displacement path of the storage tray is likewise negligibly low, on the other hand.

The feeding device selected can be in principle any device that exerts a force on the stack when depositing a sheet-shaped object. A customary spiral slot stacker is preferably used which has a stacking wheel whose fingers press on the stack when depositing a sheet-shaped object.

BRIEF DESCRIPTION OF THE DRAWING

The invention will be explained in more detail in the following with reference to the enclosed drawing on the basis of an example. The features set forth there as well as the features described above can be essential to the invention not only in the stated combination but also individually or in other combinations.

The single FIGURE shows a schematic side view of an inventive stacker for bank notes.

DETAILED DESCRIPTION OF VARIOUS EMBODIMENTS

Stacker 1 has storage pocket 4 with contact surface 5 disposed at angle $\alpha$ of about 20° to horizontal 8. Contact surface 5 is firmly connected in its upper end area with stacking wheel 3. In the lower end area of contact surface 5 end tray 16 extends upward at a right angle to contact surface 5. Contact surface 5 is provided with two slots open toward the lower end (not visible in the side view), i.e. contact surface 5 basically consists of three side-by-side, parallel bars in the lower area. End tray 16 is accordingly also formed of three bars connecting to the bars of contact surface 5.

Parallel to end tray 16, two side-by-side, parallel bars forming storage tray 7 extend from the bottom to the top through said slots in contact surface 5. Storage tray 7 is fastened at right angles to slide 15 extending under contact surface 5 parallel to contact surface 5. Slide 15 is guided slidably parallel to contact surface 5 in linear guides 14 firmly disposed on contact surface 5, so that storage tray 7 parallel to end tray 16 is displaceable in the slots of contact surface 5 so as to enlarge distance c between stacking wheel 3 and storage tray 7. The end position of storage tray 7 is reached when storage tray 7 is located at the level of end tray 16. Due to the forked structure of storage tray 7 comprising two parallel side-by-side tray portions and the accordingly offset tray portions of likewise forked contact surface 5 with end tray 16 relative to the tray portions of storage tray 7, storage tray 7 can be displaced downward in the displacement direction of slide 15 beyond end tray 16. End tray 16 can also be omitted if an end stop is provided for storage tray 7 instead.

Via extension spring 9 fastened to support piece 13 on the lower end of contact surface 5 and fastening bolt 17 on slide 15, said spring being deflected via a deflection roller 20 located in the upper end area of contact surface 5, storage tray 7 is held without additional external application of force in starting position P where minimum distance c between storage tray 7 and stacking wheel 3 is given. With suitably chosen design, minimum distance c can also tend to zero.

Feeding of storage pocket 4 is effected via stacking wheel 3 by bank notes 2 being introduced into spaces 12 between fingers 11 of stacking wheel 3 via a supply means not shown. Stacking wheel 3 rotates about axis 19, taking notes 2 along in the direction of storage pocket 4. Above storage tray 7 or stack 10 already formed of deposited notes 2, individual notes 2 are stripped out between fingers 11 of stacking wheel 3 via stripper 18 and deposited on storage tray 7 or on stack 10 parallel to storage tray 7, notes 2 lying with edge 6 against contact surface 5. As soon as stack 10 reaches minimum height c, fingers 11 of stacking wheel 3 press with their ends on uppermost deposited note 2 at pressure point D, thereby exerting a force on bank note stack 10 in the displacement direction of movable storage tray 7.

The time when the motion of movable storage tray 7 or slide 15 begins depends, on the one hand, on the spring constant of stack of sheets 10 formed and on the biasing force of extension spring 9. The spring constant of extension spring 9 is selected so that the biasing force just suffices to restore storage tray 7 reliably to starting position P upon removal of stack 10 even when the guides are soiled or worn out. On the other hand, the spring constant is selected to be extremely low so that the increase in force when moving storage tray 7 is low and the force to be applied to stack of sheets 10 by stacking wheel 3 in the displacement direction is minimal even at maximum excursion of storage tray 7. For this purpose, very long restoring spring 9 is used which is deflected, as described above. Depending on the length of the spring, multiple deflection over rolls is also possible. The spring constant of stack 10 results from the properties of notes 2 forming stack 10 and is in particular dependent on the type of notes 2 and the state of notes 2, i.e. the degree of use (old, used notes or new notes). The force exerted on stack 10 by stacking wheel 3 must be dimensioned so that it can overcome the spring force of stack 10.

The example shown in the FIGURE involves a stacker for up to 500 bank notes. Maximum pocket height a between stacking wheel 3 and end tray 16 is 111 millimeters in the present example. Distance b between starting position P of storage tray 7 and end tray 16 is 68 millimeters. It follows that storage tray 7 is displaced as of minimum stack height c of 43 millimeters. Different specifications and different choices of design result in accordingly different values.

Due to the inclined position of storage pocket 4 at angle $\alpha$ of about 20° between contact surface 5 and horizontal 8, the motion of storage tray 7 is substantially independent of the mass of bank note stack 10, since the frictional forces of edges 6 of notes 2 of stack 10 on contact surface 5 and the slope descending force cancel each other out here. Eliminating the influence of the weight of bank note stack 10 makes the passive guidance work, without requiring any separate drive. Thus, driving elements and regulation of the distance between particular last note 2 and fingers 11 of stacking wheel 3 are unnecessary, so that the structure is extremely cost-effective and low in maintenance.

The invention claimed is:

1. A stacker for bank notes comprising a feeding device for depositing the bank notes in a storage pocket with variable capacity, the storage pocket having a contact surface against which the bank notes deposited in the storage pocket lie with one edge, and a storage tray on which the bank notes are stacked in the storage pocket flat and parallel to the storage tray, and the storage tray of the storage pocket being mounted movably for changing the capacity of the storage pocket, wherein the storage pocket is disposed with contact surface at an angle to the horizontal so that the bank notes stacked in the storage pocket lie with their edges against the contact surface and the resulting frictional force between the edges of the bank notes and the contact surface substantially compensates the slope descending force acting on the stack formed of bank notes in the direction of the storage tray, and the feeding device exerts a force on the stack when depositing a bank note at least as of a certain stack thickness, thereby moving the storage tray so as to enlarge the capacity of the storage pocket, and the angle between the contact surface and the horizontal is between 20° and 30°;

wherein the storage tray is urged by means of a spring element into a starting position defined as a position closest to the feeding device;

wherein the spring element includes an extension spring that is bent between the displaceable storage tray and a fixed point of support, while being deflected via deflection elements;

wherein when the storage tray is in the starting position, the spring element has a length longer than a maximum range of displacement of the storage tray.

2. The stacker according to claim 1, wherein the storage tray is urged by means of a spring element into a starting position and displaced by the feeding device against the spring force of the spring element.

3. The stacker according to claim 1, wherein the angle between the contact surface and the horizontal is about 20°.

4. The stacker according to claim 1, wherein the feeding device includes a stacking wheel having fingers that press on the stack when depositing a bank note, thereby exerting a force on the storage tray and displacing the storage tray.

5. The stacker according to claim 2, wherein the spring element has a spring constant for minimizing the force to be applied by the feeding device for displacing the storage tray.

6. The stacker according to claim 1, wherein the distance of the storage tray from the feeding device in the starting position is at least 43 mm.

* * * * *